US012270009B2

(12) United States Patent
Sun et al.

(10) Patent No.: US 12,270,009 B2
(45) Date of Patent: Apr. 8, 2025

(54) PLASTIC WASTE CONVERSION TO LUBRICANT PRODUCTION

(71) Applicant: UCHICAGO ARGONNE, LLC, Chicago, IL (US)

(72) Inventors: Pingping Sun, Downers Grove, IL (US); Guiyan Zang, Woodridge, IL (US); Theodore R. Krause, Naperville, IL (US); Amgad A. Elgowainy, Lisle, IL (US); Ryan Hackler, Chicago, IL (US); Massimiliano Delferro, Chicago, IL (US); Vincenzo Cappello, Chicago, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 350 days.

(21) Appl. No.: 17/816,899

(22) Filed: Aug. 2, 2022

(65) Prior Publication Data

US 2023/0109450 A1 Apr. 6, 2023

Related U.S. Application Data

(60) Provisional application No. 63/250,757, filed on Sep. 30, 2021.

(51) Int. Cl.

| | |
|---|---|
| ***C10M 177/00*** | (2006.01) |
| ***C10M 107/04*** | (2006.01) |
| *C10N 70/00* | (2006.01) |

(52) U.S. Cl.
CPC ..... *C10M 177/00* (2013.01); *C10M 107/04* (2013.01); *C10N 2070/00* (2013.01)

(58) Field of Classification Search
CPC ..... C10N 2070/00; C10M 177/00; C10M 105/04; C10M 107/04; C10M 2205/0225; C10M 2203/1025
See application file for complete search history.

(56) References Cited

U.S. PATENT DOCUMENTS

2012/0184787 A1* 7/2012 Miller ..... C10M 175/0025 585/1

OTHER PUBLICATIONS

Celik et. al., Upcycling Single-Use Polyethylene into High-Quality Liquid Products, ACS Cent. Sci. 2019, 5 (11), 1795-1803 (Year: 2019).*

* cited by examiner

*Primary Examiner* — Vishal V Vasisth
(74) *Attorney, Agent, or Firm* — MARSHALL, GERSTEIN & BORUN LLP

(57) ABSTRACT

A process for converting plastic feedstock into a lubricant on an industrial scale can include a reactor having a filter integrated therein to allow for separation and recovery of catalyst so it can be washed and reused in subsequent conversion processes. Such recycling of the catalyst can allow for an industrial scale conversion process.

20 Claims, 9 Drawing Sheets

PLASTIC WASTE CONVERSION TO LUBRICANT PRODUCTION

CROSS-REFERENCE TO RELATED APPLICATIONS

The benefit of priority of U.S. Provisional Application 63/250,757 filed on Sep. 30, 2021 is hereby claimed and the disclosure thereof is incorporated herein by reference in its entirety.

STATEMENT OF GOVERNMENT SUPPORT

This invention was made with support under Contract No. DE-AC02-06CH11357 awarded by the United States Department of Energy to U Chicago Argonne, LLC, operator of Argonne National Laboratory. The government has certain rights in the invention.

BACKGROUND

Field of the Disclosure

The disclosure is directed to a process for conversion of plastic waste to a lubricant product and more particularly to a process for conversion of plastic waste to a lubricant product using selective hydrocracking.

BRIEF DESCRIPTION OF RELATED TECHNOLOGY

Waste plastics have a high energy density. For example, in the U.S. the average non-recycle plastic waste had a lower heating value (LVH) of 36 MJ/kg in 2014. This is considerably higher than the LHV for coal (26 MJ/kg) and petroleum coke (31 MJ/kg). As such, plastic waste is an untapped resource with great potential for energy recovery. Implementing a technology aimed at recovering this energy content of plastic waste not only provides a viable and low cost alternative (given it is waste and has zero cost except for fees related to sorting) to fossil fuels for providing energy, but also can significantly reduce the land pollution and ocean pollution caused by solid waste disposal.

Recent laboratory research demonstrated that plastic waste can be converted to lubricant product using a highly selective Pt based catalyst (Celik et. al., *Upcycling Single-Use Polyethylene into High-Quality Liquid Products*, ACS Cent. Sci. 2019, 5 (11), 1795-1803; Hackler et. al. Synthetic Lubricants Derived from Plastic Waste and their Tribological Performance, ChemSuSChem, 2021, doi.org/10.1002/cssc.202100912). Lubricant is a petroleum product and considered one of the highest valued refinery products. Lubricants are priced at $72/mm BTU, which is considerably higher than crude oil which is priced at $12/mm BTU, transportation fuels (gasoline and diesel), which are priced between $12-13/mmBTU, and BTX, which is priced at about $15-25/mm/BTU. U.S. refineries produced 64.97 million barrels (8.9 million MT) of lubricants in 2017, with a market value of $20 billion dollars.

SUMMARY

There is a need for a process capable of converting plastic waste into lubricant products on an industrial scale. The lubricant products resulting from the conversion by the process described herein are referred to as high quality liquids (HQL).

A process for conversion of a plastic feedstock to a liquid lubricant product in accordance with the disclosure can include heating the plastic feedstock in the presence of a hydrogenolysis/hydrocracking catalyst in a conversion reactor with a flow of $H_2$ to a conversion temperature to form a slurry; holding the slurry at the conversion temperature for a retention time sufficient to convert substantially all of the plastic feedstock to a liquid lubricant; removing the liquid lubricant from the conversion reactor and flowing the liquid lubricant into a distillation column, wherein the liquid lubricant is separated from the hydrogenolysis/hydrocracking catalyst before the liquid lubricant is flowed into the distillation column; recovering the hydrogenolysis/hydrocracking catalyst separated from the liquid lubricant and transferring the recovered catalyst to a catalyst filter unit after the liquid lubricant is removed from the conversion reactor; washing the recovered catalysts in the catalyst filter using hexane introduced into the catalyst filter, wherein any lubricant remaining on the recovered catalysts will be dissolved into the hexane during washing; returning the washed catalyst to the conversion reactor for reuse; flowing the hexane after catalyst washing to the distillation column; purifying the liquid lubricant and hexane in the distillation column to recover hexane; recovering the purified hexane for reuse; and collecting the liquid lubricant product.

DETAILED DESCRIPTION

An industrially relevant process for converting plastic waste into lubricants can beneficially include separation and recycling of the catalyst after the reaction with the plastic waste. Such separation and recovery is needed for a cost-effective process. Particularly, the high viscosity of both feedstock (after melting) and product requires efficient separation at elevated temperature.

Figure 4:
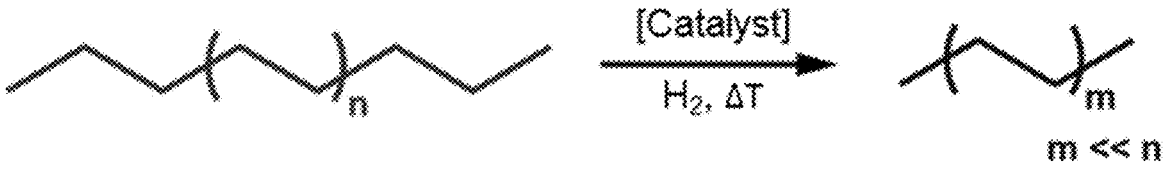
FIG. 4 is a schematic illustration of the reaction for converting plastic feedstock to a lubricant.

A process for conversion of a plastic feedstock to a liquid lubricant product can include heating the plastic feedstock in the presence of a hydrogenolysis/hydrocracking catalyst to convert the plastic feedstock to a hydrocarbon product. The hydrocarbon can have from about 1 to about 50 carbons. For example, a $C_{44}$ hydrocarbon can be produced from conversion of the plastic feedstock. FIG. 4 is a schematic illustration of the conversion process using a hydrogenolysis/hydrocracking catalyst, along with heat and $H_2$.

The plastic feedstock can be or include one or more of HDPE, LDPE, and LLDPE. For example, the plastic feedstock can be post-consumer recycled plastic waste. This can include a mixture of different plastics. The plastic feedstock can be in the form or treated to be in the form of pellets, chips, and/or flakes.

The process can include a plastic pretreatment depending on the type of plastic to be converted. For example, conversion of post-consumer plastic would benefit from a pretreatment process. The pretreatment can include, washing, drying, and crushing steps. The pretreatment equipment of phase of the facility can include a washer, dryer, and crusher. For example, the feedstock during pretreat can be washed to remove residual product contained in the plastics. For example, the feedstock can be crushed to be in pellet, chip or flake form.

The process can include heating the plastic feedstock in the presence of the catalyst to a conversion temperature of about 200° C. to about 450° C. For example, the conversion temperature can be about 300° C.

Once the conversion temperature is reached, the plastic feedstock can be held for a retention time of about 6 hours to about 96 hours. For example, the retention time can be about 72 hours.

$H_2$ is flowed into the conversion reactor during the heating. The $H_2$ can be flowed at a flow rate of about 30 kg/hr to about 600 kg/hr, at a pressure of 170 psi to 500 psi.

The process can include flowing a hydrocarbon solvent into the conversion reactor with the plastic feedstock. The hydrocarbon solvent can be a light hydrocarbon, such as, but not limited to, butane, pentene, hexane, and naphtha. The hydrocarbon solvent can be co-fed to the reactor with the plastic feedstock. This can aid mass transfer to further reduce retention time. When a hydrocarbon solvent is included, the resulting liquid lubricant will be admixed with the hydrocarbon solvent. The admixture can be separated from the catalyst and the hydrocarbon solvent can be separated from the liquid lubricant in the distillation column. The hydrocarbon solvent can be recovered from the distillation column and reintroduced into the conversion reactor for reuse.

The process includes separating the catalyst from the produced liquid lubricant prior to the liquid lubricant being flowed into the distillation column. Separation can be performed in the conversion reactor itself or in an external filtration unit. For example, the catalyst filter unit can be used to separate the catalyst from the liquid lubricant prior to washing the catalyst. Alternatively, a separate filter unit could be provided such that the slurry is first flowed to the filter unit to separate the catalyst and the liquid lubricant. After separation, the liquid lubricant can be flowed to the distillation column and the catalyst can be introduced into the catalyst filter unit for washing.

In embodiments in which the separation occurs in the conversion reactor, the conversion reactor, with a mixing agitator, can include a filter arranged in the interior volume of the reactor (built in filter). Solid catalyst and solid plastic feedstock can be introduced into the reactor such that it resides above or on a top surface of the filter. The filter can prevent the solids from passing through and entering a bottom region of the reactor but can allow liquid lubricant generated during the conversion process to pass through such that it resides on the bottom of the reactor, thereby providing separation from the solids. The liquid lubricant can be removed from the bottom of the reactor, while the solid catalyst remains within the reactor. The liquid lubricant can be flowed to a distillation column for purification as detailed below.

The solid catalyst can be removed from the reactor after removal of the liquid lubricant, for example by vacuum, then conveyed for washing. Any suitable method of collecting and introducing the catalyst into a washing unit can be used, referred to herein as a catalyst filter unit The catalyst filter unit can be a candle filter. For example, a FUNDABAC® (DrM, Dr. Mueller AG) could be used. A candle filter could similarly be used as separate unit, separate from the washing unit to separate the catalyst from the liquid lubricant prior to washing, but external from the conversion unit.

The catalyst can be washed with hexane or other solvent (e.g. pentane or other paraffin) that can dissolve paraffinic lubricant in the filter unit. The hexane can be flowed to an external source. During washing, hexane will dissolve residual lubricant on the catalysts thereby cleaning the lubricant from the catalyst. The washed catalyst can be recovered from the filter unit and the recovered catalyst can be used in the conversion reactor for further conversion reactions. Hexane used during the washing can be flowed from the filter unit to the distillation column, wherein the solved lubricant is separated from the hexane and purified hexane is recovered from the distillation column for reuse in the catalyst washing process.

The solid catalyst can be a one or more catalytic metal selected platinum group metals and/or transition metals. For example, the catalytic metal can be Pt, Pd, Ni, Co, and combinations thereof. The catalytic metal can be provided on a support. The support can be for example, a metal oxide. Examples of support materials include, but are not limited to one or a combination of SrTiO3, TiO2, MgO, $WO_3$, $ZrO_2$, amorphous aluminosilicate, and modified zeolite. For example, the hydrogenolysis/hydrocracking catalyst can be one or more of Pt disposed on a metal oxide support, Pt alloy catalysts, NiMo catalyst, and CoMo catalyst. The catalytic metal can be provided on the support in an amount, based on the total weight of the catalyst, of about 0.1 wt % to about 20 wt %, about 0.1 wt % to 2 wt %, about 1 wt % to about 2 wt %, about 1 wt % to about 5 wt %, about 2 wt % to about 5 wt %, and any values or ranges there between. For example, the catalytic metal can be provided on the support in an amount, based on the total weight of the catalyst of about, 0.1, 0.2, 0.3, 0.4, 0.5, 0.6, 0.7, 0.8, 0.9, 1, 1.5, 2, 2.5, 3, 3.5, 4, 4.5, 5, 5.5, 6, 6.5, 7, 7.5, 8, 8.5, 9, 9.5, 10, 11, 12, 13, 14, 15, 16, 17, 18, 19, or 20 wt %. For example, the catalyst can be about 5 wt % Pt as the catalytic metal, based on the total weight of the catalyst.

The catalyst can be used in ratio of about 1:10 to 1:20 per kg of plastic feed stock.

Hexane and liquid lubricant can be purified in the distillation column. Hexane from the washing of the catalyst can be purified to remove any solved lubrication, which can be further purified with the liquid lubricant to form the liquid lubricant product. The liquid lubricant product can be a high quality liquid, for example. Hexane can be recovered from the distillation column and reused for subsequent washing cycles.

The catalyst can be washed and reused in the process of the disclosure for long periods of time. This makes the process of the disclosure available as a large scale process as it is both economical and efficient. For example, the catalyst can be used in a process of the disclosure for repeated conversion cycles for 2-3 years or more.

Figure 3A:
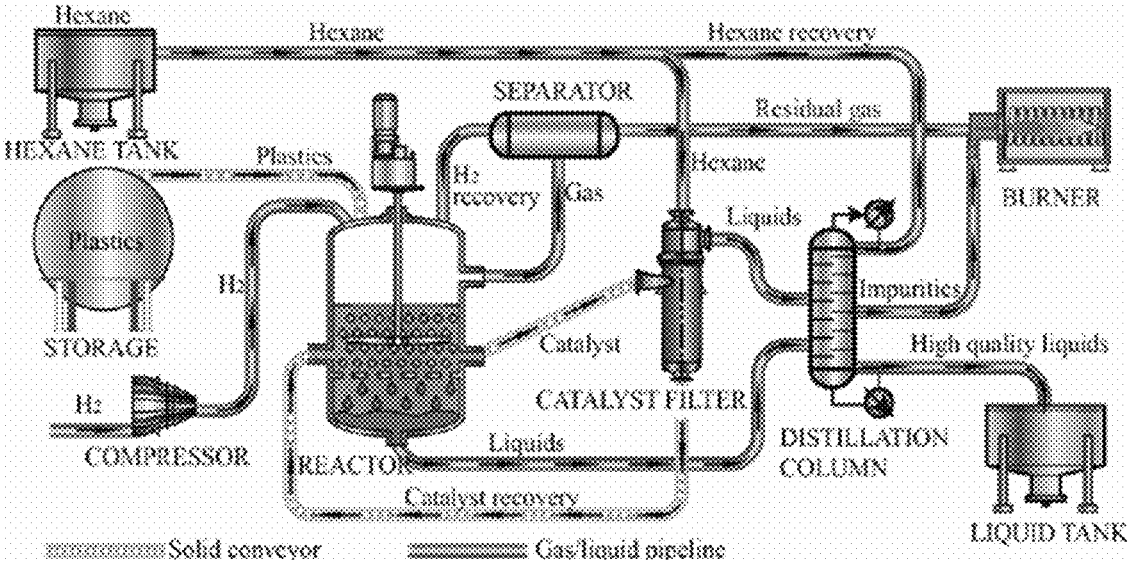
FIG. 3A is a schematic illustrations of a process in accordance with the disclosure.
Figure 3B:
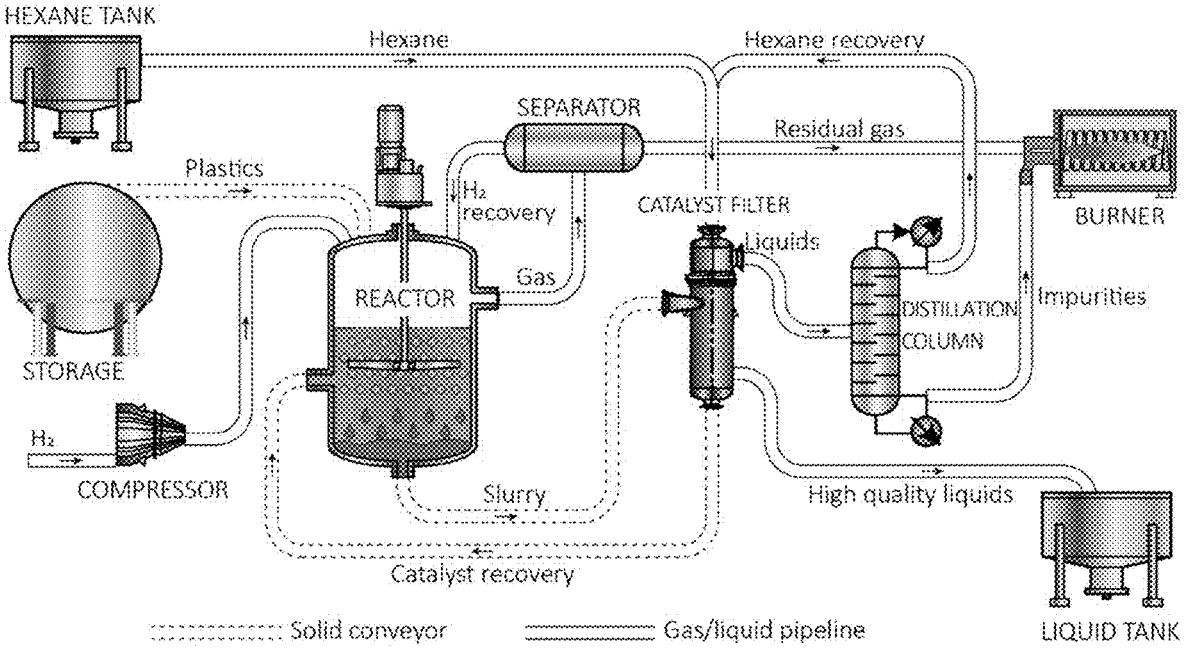
FIG. 3B is a schematic illustration of a process in accordance with the disclosure.

FIGS. 1A and 1B illustrates process flow diagrams of a method of the disclosure. As illustrated in FIGS. 3A and 3B, plastic feedstock is loaded into the reactor, along with catalyst and $H_2$ is flowed through. As described above, the plastic feedstock is introduced into a conversion reactor. In the embodiment of FIG. 3A, a conveyor is illustrated, however, any known means of introducing the plastic feedstock into the reactor can be used.

In the process diagram FIG. 3A, the reactor includes a filter. The plastic feedstock and solid catalyst are introduced into the reactor above the filter. The filter allows for separation of the solid catalyst from the produced liquid lubricant within the conversion reactor. As the plastic feedstock is heated and converted to the liquid lubricant, the liquid flows through the filter to a bottom of the reactor, leaving the solid catalyst above the filter.

FIG. 3B illustrates a process in which an external filtration system is used to separate the catalyst from the liquid lubricant. In this arrangement, the slurry from the conversion reactor is flowed to the catalyst filter unit for separation and then washing of the catalyst. For example, a candle filter can separate nano-sized catalysts from the liquid phase at elevated temperature up to 300° C. For example, the resultant slurry (liquid product and catalyst particles) can be pumped to the candle filter for separation. Once the specified cake thickness is achieved, the vessel can be drained for washing with hexane.

In any of the arrangements, unreacted $H_2$ gas and/or $C_1$-$C_8$ hydrocarbon gas may form during the conversion process. The gas can be vented from the reactor. In some embodiments, the gas can be burned to provide heat energy back into the system. In some embodiments, the gas can be separated after venting and $H_2$ can be recycled back into the reactor for subsequent conversion reaction. The $C_4$-$C_8$ hydrocarbons can be separated (e.g. distillation, compression, refrigeration) and introduced into the conversion reactor as a solvent. For example, the $C_4$-$C_8$ hydrocarbons can be used as a solvent to co-feed with plastic waste feedstock.

Figure 5A:
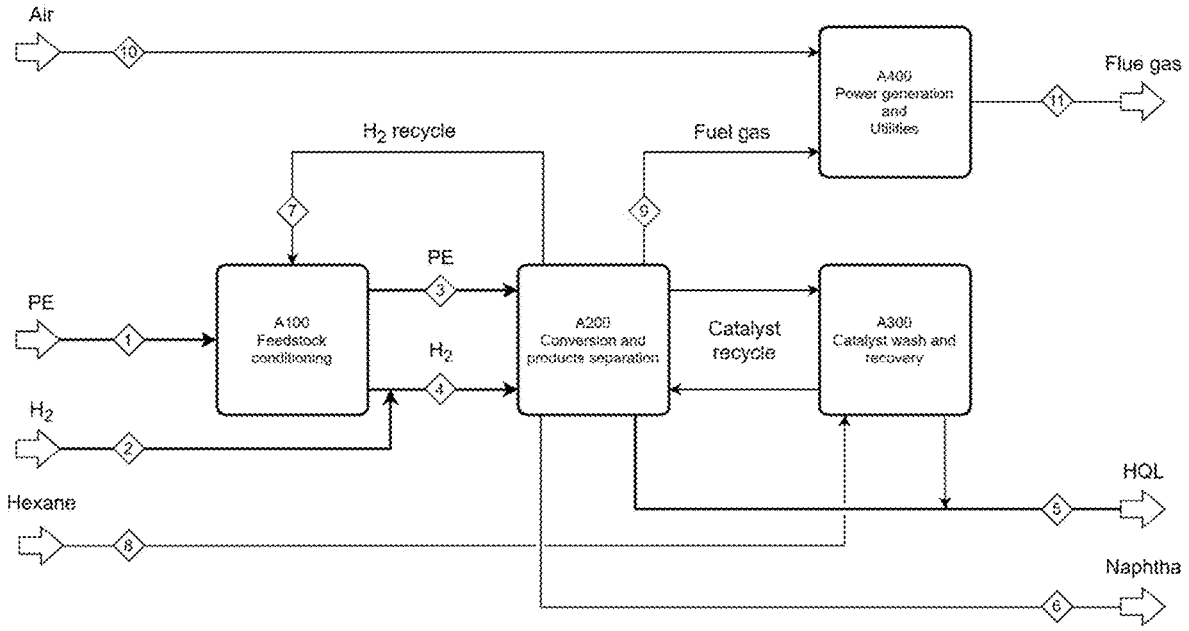
FIG. 5A is a simplified block diagram of a conversion process of the disclosure showing the main streams
Figure 5B:
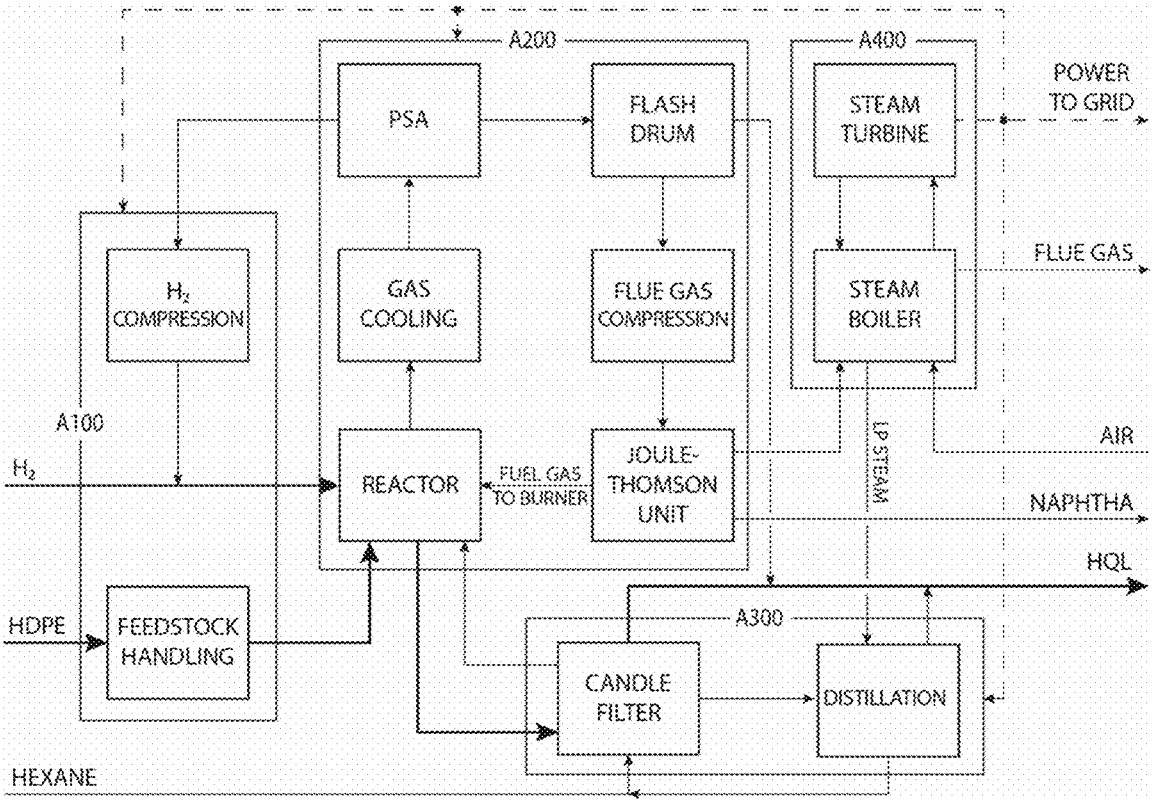
FIG. 5B is a block diagram of a conversion process in accordance with the disclosure.

Referring to FIG. 5B, the process can include a Joule-Thomson unit for gas-liquid separation and recovery of $C_4$-$C_8$ hydrocarbons, also referred to as naphtha or natural gas liquid (NGL). This recovered stream can be valorized as naphtha blendstock. Less hydrocarbons would also be combusted as a result of this separation, reducing emissions produced on site.

FIG. 5A shows a simplified block diagram or HDPE conversion to HQL in accordance with the disclosure, in which the main streams are highlighted. FIG. 5B illustrates a full process block diagram of the process of the disclosure including the Joules-Thomson unit. At A100, HDPE feedstock is pretreated and recycled $H_2$ from the system is compressed. The feedstock is them transferred to block A200 for hydrogenolysis of the plastic. Liquid products are separated from the slurry phase using candle filters, however, other separation methods are contemplated herein. The gas stream flow through PSA to recover unreacted $H_2$.

Hydrocarbons ranging from $C_3$-$C_8$ are recovered using a Joule-Thomson unit. The catalyst is washed with hexane at A300. The remaining fuel gas is combusted to produce power and steam.

Figure 9:
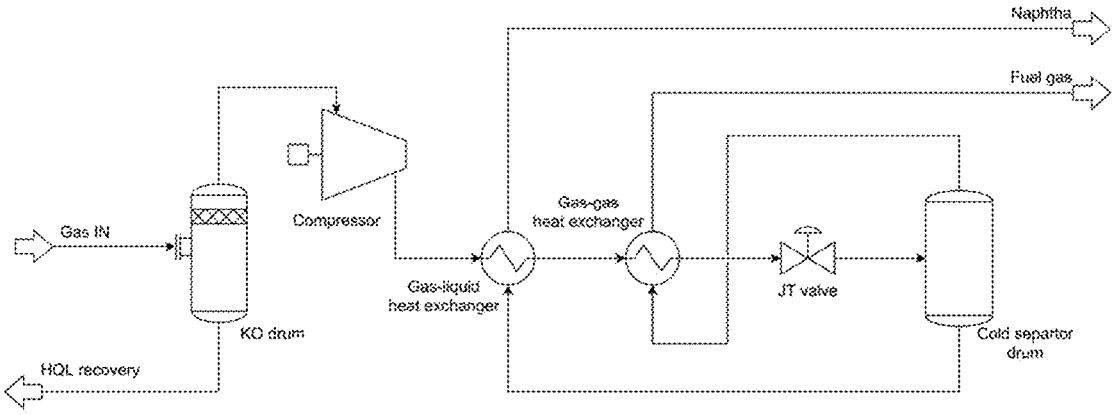
FIG. 9 is schematic illustration of Joule-Thomson unit for recovery of the naphtha fraction used in processes of the disclosure.

FIG. 9 shows a flow schematic of a Joule-Thomson unit to recover a naphtha fraction. After separating the heavy liquid phase entrained in the gas stream, the gas products are compressed to at least 100 bar. This can allow for the necessary cooling after gas expansion in the Joule-Thomson unit. The Joule-Thomson unit includes heat exchangers to precool the high-pressure gas with the low-temperature products.

As described above, in some embodiments of the process, a hydrocarbon solvent can be introduced into the conversion reactor with the plastic feed stock. In such embodiments, the gas produced in the conversion reactor can include a hydrocarbon. The gas can be vented from the reactor and diverted for combustion for heat supply or diverted to refrigerated separation for the recovery of naphtha and/or LPG or as hydrocarbon solvent.

In any of the arrangements, after washing, the solids will be dried via gas pressure and then discharged as a dry cake. Further, as shown in FIG. 3B, hexane can be recovered from the distillation process and recycled into the catalyst filter for reuse.

Liquid lubricant produced in the reactor can be removed from the bottom of the reactor (reactor with built in filtration) or after external filtration unit and flowed to a distillation column for purification and ultimately collection.

Washed catalyst can be recovered from the catalyst filter and reintroduced into the conversion reactor for reuse. Washing and drying of the catalyst can be achieved inside the filter unit, after discharging the lubricant products as filtrate. The catalyst is collected after disrupting the dry cake via gas pressure.

In the distillation column, liquid lubricant remained dissolved in the filter is separated from the washing solvent (e.g., hexane), which is then recovered. The purified hexane is removed from the distillation column and recycled into the process for reuse in the catalyst washing procedure, while the bottom product is sent to increase the LHV of the fuel.

Processes of the disclosure can advantageously achieve high yields HQL, such as 60% or more, 70% or more, 80% or more, and 90% or more. For example, the processes of the disclosure can achieve yields of HQL from 60% to 90%.

Processes of the disclosure can have significant environmental benefit. For example, the process can result in significant reduction of solid waste in landfills and waterways, without production of and required disposal of solid char. Further, as compared to production of refinery lubricant or polyalphaolefin (PAO), the process of the disclosure has significantly reduced green-house gas emissions.

Figure 1:
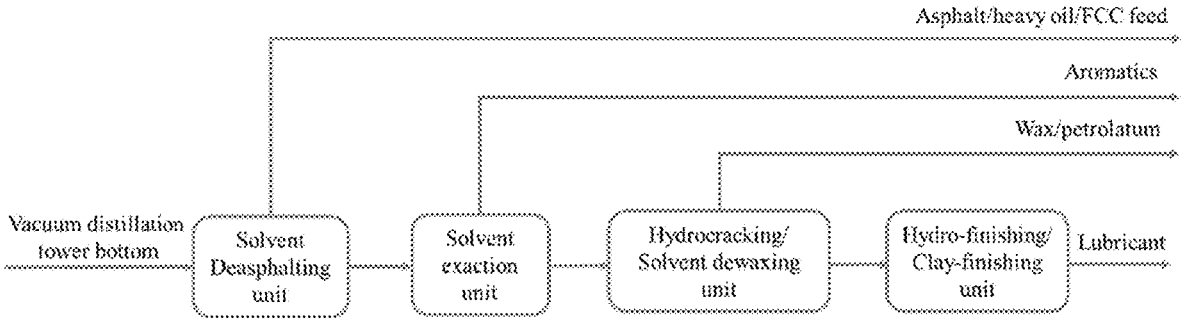
FIGURE1 PRIOR ART
FIG. 1 is a conventional refinery process for forming a lubricant.
Figure 2:
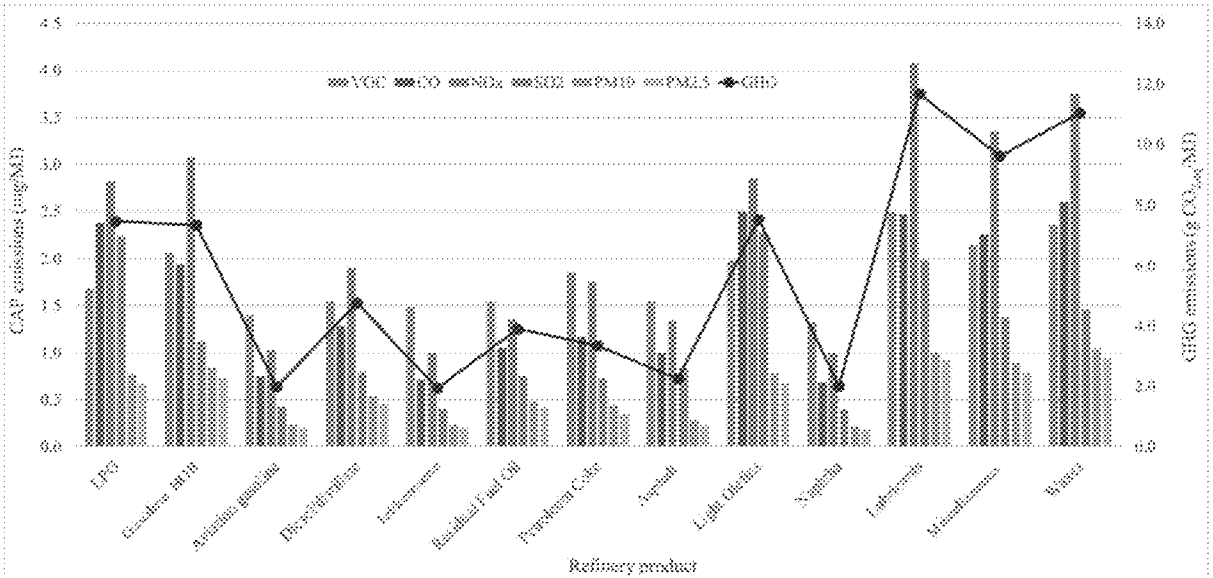
FIGURE 2 PRIOR ART
FIG. 2 is a graph showing green-house gas emissions resulting from conventional refinery processes for producing lubricants

The production of lubricant is energy and emission intensive. FIG. 1 illustrates a flow diagram for industrial production of mineral oil/lubricant base oil from crude oil. Refinery lubricant such as illustrated in FIG. 2 release about 11.5 g $CO_2$ eq/MJ lubricant (or 0.5 kg $CO_2$ eq/kg lubricant) in refinery facilities (onsite), which is significantly higher than for production of gasoline blendstock for oxygenate blending (BOB) (7.3 g $CO_2$ eq/MJ or 0.3 kg $CO_2$ eq/kg gasoline BOB), and diesel production (4.7 g $CO_2$ eq/MJ, or 0.2 kg $CO_2$ eq/kg gasoline BOB) (FIG. 5). Note there are the direct emissions released inside refineries during the production process.

In addition, the lubricant production also incurs indirect emissions or the upstream burdens related to the production of feedstock or materials that are used by refineries. By including the $CO_2$ emission associated with refinery upstream burdens (e.g. crude oil recovery, electricity and hydrogen production), the refinery lubricant wells to gate $CO_2$ emission is about 0.98 kg/kg lubricant product. Raimondi, A., Girotti, G., Blengini, G. A. et al. LCA of petroleum-based lubricants: state of art and inclusion of additives. Int J Life Cycle Assess 17, 987-996 (2012). https://doi.org/10.1007/s11367-012-0437-4

It is worth noting that the lubricant produced from plastic waste has higher quality than the refinery lubricant (group I, II and III), but rather similar with that of group IV or synthetic lubricant, or PAO (polyalphaolefin). The PAO catalyst has a well to gate $CO_2$ emission of 1.9 kg $CO_2$ eq/kg lubricant. Giorgia Girotti, Andrea Raimondi, Gian A. Blengini and Debora Fino, The Contribution of Lube Additives to the Life Cycle Impacts of Fully Formulated Petroleum-Based Lubricants, American Journal of Applied Sciences DOI: 10.3844/ajassp.2011.1232.1240, Volume 8, Issue 11, Pages 1232-1240

Processes of the disclosure can have significantly reduced green-house gas emissions as compared to refinery processes and PAO production process. In contrast, the lubricant product derived from plastic waste has well to gate $CO_2$ emission of 0.5-1.7 kg $CO_{2e}$/kg lubricant, depending on catalyst loading and operating conditions, lower than the $CO_2$ emission from the current lubricant production, 0.98-1.9 kg/kg lubricant for group I, II, III and IV.

A process to upgrade HDPE waste to high-quality liquid in accordance with the disclosure can advantageously provide a means to address the plastic management issues while being economically profitable with an estimated MSP of the lubricant-like product of \$1.83 $gal_{HQL}^{-1}$ (\$0.60 $kg_{HQL}^{-1}$), considering the market price for group III and PAO lubricants in the range \$6-10 $gal^{-1}$. The main parameters that affected the production costs were the cost of plastic waste and the amount of $Pt/SrTiO_3$ catalyst needed.

The process for lubricant production in accordance with the disclosure can have significant environmental and national energy security benefits. For the former, our proposed technology has extraordinary benefit in solid waste reduction in landfill and in waterways, without producing and disposing solid char. This is especially important for the U.S. as the waste export market continues to dwindle as foreign countries ban the importing of waste. For the latter, the process of the disclosure could reduce GHG emissions significantly compared to refineries by displacing the energy intensive lubricant production process. The LCA showed that lubricant produced from plastic waste had an onsite $CO_2$ emission as low as 0.24 $kg_{CO2}$ $kg_{Lub}^{-1}$ (0.72 $kg_{CO2}$ $gal_{HQL}^{-1}$), which was significantly lower than the $CO_2$ emission from petroleum lubricant (0.89-1.35 $kg_{CO2}$ $kg_{Lub}^{-1}$). Based on the U.S. lubricant production of 60.87 million barrels in 2019, replacing petroleum-derived lubricant with plastic waste-derived lubricant could reduce $CO_2$ emissions between 3 and 9 million MT per year in the U.S.

EXAMPLES

Example 1: Lab Scale Hydrogenolysis

Figure 10:
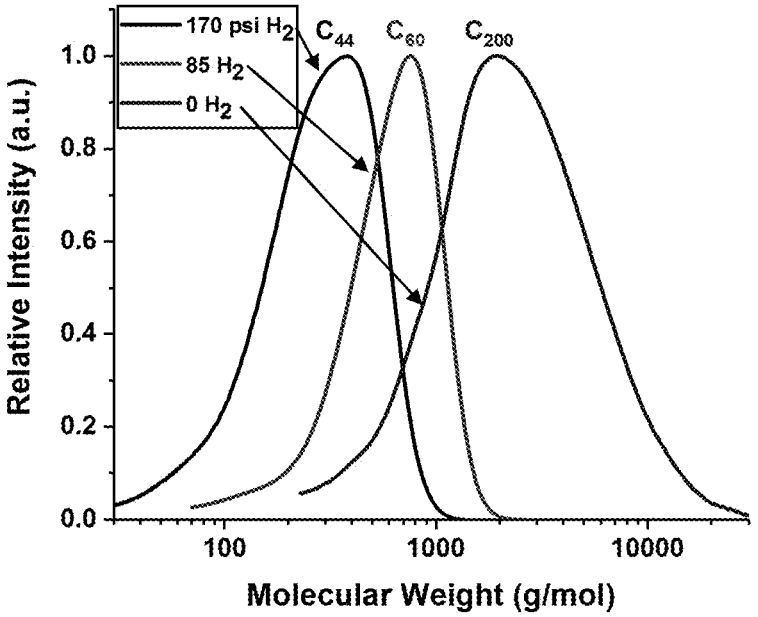
FIG. 10 is a graph showing distribution plots of hydrogenolysis products at varying H2 pressures after 72 h, as determined by GPC. The hydrogen-free run amounts to catalytic thermal degradation. Carbon number labels are roughly calculated from Mw data.
Figure 11:
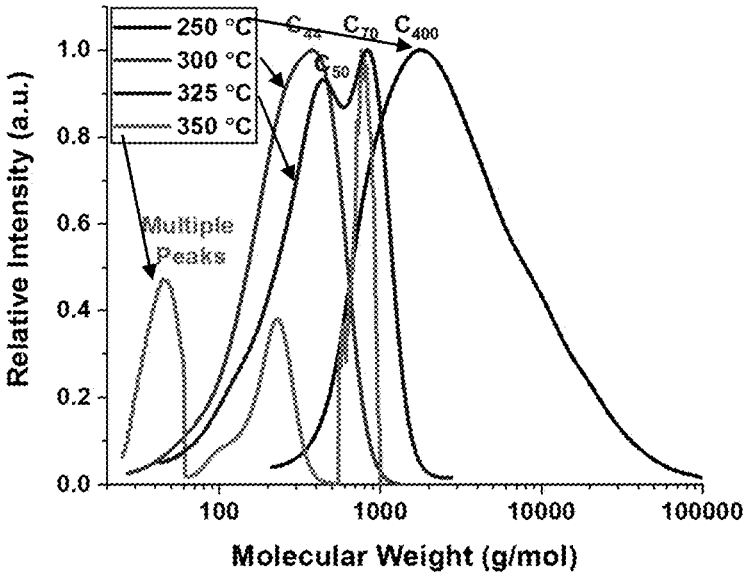
FIG. 11 is a graph of distribution plots of hydrogenolysis products at varying temperatures after 72 h, as determined by GPC. Hydrogenolysis at 325 and 350° C. (blue, green respectively) show multiple peaks and thus the presence of other degradative processes, such as catalytic pyrolysis. Carbon number labels are roughly calculated from Mw data.
Figure 12:
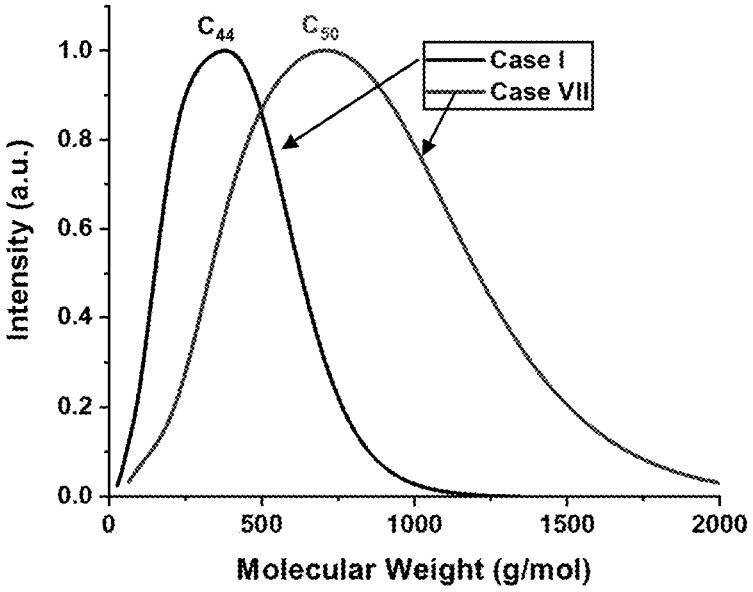
FIG. 12 is a graph of distribution plots of hydrogenolysis products from case I and case VII described in the main text, as determined by GPC. While the molecular weight and polydispersity of case VII are larger than case I, these differences are minor and do not greatly impact the viability of the case VII product as a lubricant. Carbon number labels are roughly calculated from Mw data.

Hydrogenolysis of polyethylene was done in a Parr autoclave reactor using about 3 g of polymer and varying amounts of Pt/STO catalyst, along with variations in $H_2$ pressure (FIG. 10), temperature (FIG. 11). The largest changes with respect to run time and catalyst loading are discussed in the main text, and distribution plots for the resulting lubricant products are shown in FIG. 12. Ambient atmosphere was discharged from the reactor prior to heating by flushing the lines, valves, and reactor with He. The reactor was then heated up to 300° C. at roughly 5-10° C./min until a stable temperature was established for 30 min. To minimize mass transfer limitations, a mixing impeller was set to about 800 rpm. Characterization of the lubricant products was done by high-temperature gel permeation chromatography (HT-GPC) (Agilent-Polymer Laboratories 220) equipped with RI and viscometer detectors. Monodisperse polystyrene (ranging from 400 Da to 1.1 MDa) and monodisperse polyethylene (ranging from 300 Da to 120,000 Da) standards were tested to establish a calibration curve. The GPC column set included 3 Agilent PL-Gel Mixed B columns and 1 PL-Gel Mixed B guard column. 1,2,4-trichlorobenzene (TCB) containing 0.01 wt % 3,5-di-tert-butyl-4-hydroxytoluene (BHT) was chosen as the eluent at a flow rate of 1.0 mL/min at 150° C. The lubricant products were prepared in TCB at a concentration of about 2.0 mg/mL and heated at 150° C. for 24 h prior to injection and analysis.

Example 2: Facility Model

A conceptual facility to convert 250 MT per day of PE post-consumer waste into lubricant-range molecules was designed, based laboratory results about polyethylene hydrogenolysis detailed in previous studies. G. Celik, R. M. Kennedy, R. A. Hackler, M. Ferrandon, A. Tennakoon, S. Patnaik, A. M. LaPointe, S. C. Ammal, A. Heyden, F. A. Perras, M. Pruski, S. L. Scott, K. R. Poeppelmeier, A. D. Sadow and M. Delferro, *ACS Cent. Sci.*, 2019, 5, 1795-1803; and R. A. Hackler, K. Vyavhare, R. M. Kennedy, G. Celik, U. Kanbur, P. J. Griffin, A. D. Sadow, G. Zang, A. Elgowainy, P. Sun, K. R. Poeppelmeier, A. Erdemir and M. Delferro, *ChemSusChem*, DOI:10.1002/cssc.202100912. The process was modelled by using the software Aspen Plus v12. Two case studies were considered: a high-yield case (HY) based on the best up to date test results, and a conservative case characterized by a low-yield (LY). The operating conditions for both cases are listed in Table 1, below. The simulated process to convert recovered plastic wastes to high-quality liquids (HQL) consisted of four main process areas. FIG. 3 illustrates the process scheme.

TABLE 1

Operating conditions for the low-yield and high-yield case studies.

| Parameter | LY | HY |
|---|---|---|
| Lubricant yield | 0.6 | 0.9 |
| Catalyst:PE | 0.1 | 0.05 |
| Reaction time/h | 72 | 40 |
| $Pt:SrTiO_3$ | 0.1 | 0.02 |
| Reaction temperature/° C. | 300 | |
| Pressure/bar | 11.7 | |
| Feedstock/MT $day^{-1}$ | 250 | |

In Area 100 (A100), four pretreatment lines consisting of washer, dryer, and crusher handled the bales of mixed HDPE before conveying the pelletized feedstock to the reactor. In A200, the hydrogenolysis was carried out in an agitated reactor at 300° C. and 11.7 bar. In the presence of Pt/SrTiO3 catalyst, HDPE (Mw=35,000 Da) was fully converted to HQL and other lighter hydrocarbon products based on the following chemical equations for the low-yield and high-yield cases, respectively:

$$(C_2H_4)_{1250}+528.5H_2=270CH_4+90C_2H_6+43.3C_3H_8+40C_4H_{10}+14C_5H_{12}+13.3C_6H_{14}+10C_7H_{16}+5C_8H_{18}+42.9C_{35}H_{72}.$$

$$(C_2H_4)_{1250}+185.7H_2=67.5CH_4+22.5C_2H_6+10.8C_3H_8+10C_4H_{10}+3.5C_5H_{12}+3.3C_6H_{14}+2.5C_7H_{16}+1.3C_8H_{18}+64.3C_{35}H_{72}.$$

The catalyst can be designed to achieve a narrow product distribution. The n-$C_{35}H_{72}$ component was used to characterize the properties of the HQL (LHV=44.26 MJ kg-1, density=800 kg $m^{-3}$). For the low-yield case, the stoichiometry was obtained considering a 60% yield in $C_{35}H_{72}$ and the fraction of lighter gases. The plastic feedstock was not available in the Aspen Plus database; hence, physical and thermodynamic properties of interest were implemented in the model. The enthalpy of formation was obtained from the gross heat of combustion value reported in the literature (i.e. 47.7 MJ $kg^{-1}$). The plastic was melted and heated up to a temperature of 300° C. with heat generated by the combustion of light gases produced on site. For the heat of fusion, the value 4.14 kJ $mol^{-1}$ was considered. Hydrogen was used in excess (i.e. 2 times the stoichiometric amount) to aid $H_2$ adsorption on catalyst surface, promote hydrogenolysis kinetics, and reduce mass transfer limitations. In the process design, the reactor was fed with 680 $Nm^3$ of hydrogen per MT of PE. The unreacted $H_2$ was recovered by pressure swing adsorption (PSA). The PSA was simulated at 9.2 bar to separate hydrogen from hydrocarbons with an overall recovery ratio of 85%. The adsorbed gases were then released after depressurization and diverted to a Joule-Thomson (JT) unit, while the recovered hydrogen was compressed to 11.7 bar. The JT unit (FIG. 9) separated the hydrocarbons in the range $C_3$-$C_8$ from the fuel gas to recover naphtha blendstock that could be sold at market price. The separation was achieved by adiabatic expansion in a JT valve, after compressing the gas to a pressure of about 120 bar. Heat exchangers were used to prechill the gas stream. The catalyst was separated from the slurry stream via two Fundabac® (DrM Inc.) candle filters in parallel. Thereafter, the separated catalyst went through washing process with hexane and transferred back to the reactor for the next batch. The used hexane was purified in a distillation column in A300, from where it was recovered as top product. The hexane loss was assumed to be 0.5%. Finally, the section A400 contained the power generation equipment and cooling tower. The temperature of cooling water varied within the range 28-37° C. The simulation parameters for the main equipment are summarized in Table 2.

TABLE 2

Simulation parameters of the main equipment.

| Process area | Unit | Aspen block | Parameter/unit | Value |
|---|---|---|---|---|
| A100 | $H_2$ compressor | Compr | Discharge pressure/bar | 11.7 |
| | | | Isentropic efficiency | 0.86 |
| A200 | Plastic heater | Heater | Temperature/° c. | 300 |
| | | | Duty/cal $s^{-1}$ | 81.59* |
| | Reactor | Rstoic | Pressure/bar | 11.7 |
| | | | Temperature/° c. | 300 |
| | | | HDPE conversion | 100%** |
| | Flash separator | Flash2 | Pressure/bar | 9.5 |
| | Gas chiller | Heater | Temperature | 43 |
| | PSA | Sep | $H_2$ recovery | 85% |
| | | | $Ch_4$ recovery | 0.1% |
| A200.jt plant | Gas compressor | Mcompr | Number of stages | 4 |
| | | | Intercooler temperature/° c. | 43 |
| | | | Discharge pressure/bar | 120 |
| | | | Isentropic efficiency | 0.86 |
| | KO drum | Flash2 | Δp/bar | 0 |
| | | | Heat/cal · $sec^{-1}$ | 0 |
| | Gas-liq. Heater | Heatx | Heat transfer coefficient/w · $m^{-2}$ · $k^{-1}$ | 63.6 |
| | | | $\Delta t_{outlet}$/k (countercurrent) | 10 |
| | Gas-gas heater | Heatx | Heat transfer coefficient/w · $m^{-2}$ · $k^{-1}$ | 30 |
| | | | $\Delta t_{outlet}$/k (countercurrent) | 10 |
| | Jt valve | Valve | Δp/bar | −115 |
| | Cold separator | Flash2 | Δp/bar | 0 |
| A300 | Catalyst filter | Sep | Solid recovery | 100% |
| | | | Liquid entrainment | 1% |
| | Hexane dist. Column | Distl | Number of stages | 15 |
| | | | Feed stage | 2 |
| | | | Reflux ratio | 0.5 |
| | | | Distillate:feed | 0.99 |
| | | | Pressure/bar | 1 |
| A400 | Boiler† | Heater #1 | Water $t_{out}$/° c. | 300 |
| | | Heater #2 | Degree superheating | 0 |
| | | Heater #3 | Steam $t_{out}$/° c. | 550 |
| | | Heater #4-6 | Δp/bar | 0 |
| | Air blower | Compr | Δp/bar | 0.3 |
| | | | Isentropic efficiency | 0.86 |
| | Steam turbine | Compr | Discharge pressure/bar | 0.04†† |
| | | | Isentropic efficiency | 0.86 |

TABLE 2-continued

Simulation parameters of the main equipment.

| Process area | Unit | Aspen block | Parameter/unit | Value |
|---|---|---|---|---|
| | Water condenser | Heater | Δp/bar | 0 |
| | | | Vapor fraction | 0 |
| | Water pump | Pump | Discharge pressure/bar | 112 |
| | | | Efficiency | 0.78 |

*Based on the heat of fusion of HDPE.

†The boiler was made of an economizer, vaporizer, and superheater, each heater modeled as a couple of heater blocks to describe the water/steam side and the hot gases side.

††Obtained from Calculator, based on the water saturation pressure at the outlet conditions (T = 30° C.).

TABLE 3

Conversions and stoichiometry defined for the reactor model. The conversion values to C1-C8 were based on the data published in Celik et al. [1]A total conversion of HDPE was assumed for both cases.

| HDPE CONVERSION (60% YIELD) | HDPE CONVERSION (90% YIELD) | STOICHIOMETRY |
|---|---|---|
| 0.108 | 0.027 | HDPE + 2500 $H_2$ = 2500 $CH_4$ |
| 0.072 | 0.018 | 2 HDPE + 2500 $H_2$ = 2500 $C_2H_6$ |
| 0.052 | 0.013 | 3 HDPE + 2500 $H_2$ = 2500 $C_3H_8$ |
| 0.064 | 0.016 | 4 HDPE + 2500 $H_2$ = 2500 $C_4H_{10}$ |
| 0.028 | 0.007 | 5 HDPE + 2500 $H_2$ = 2500 $C_5H_{12}$ |
| 0.032 | 0.008 | 6 HDPE + 2500 $H_2$ = 2500 $C_6H_{14}$ |
| 0.028 | 0.007 | 7 HDPE + 2500 $H_2$ = 2500 $C_7H_{16}$ |
| 0.016 | 0.004 | 8 HDPE + 2500 $H_2$ = 2500 $C_8H_{18}$ |
| 0.600 | 0.900 | 35 HDPE + 2500 $H_2$ = 2500 $C_{35}H_{72}$ |

Life Cycle Assessment (LCA)

A LCA based technique was applied to estimate the carbon footprint for lubricant synthesis processes from plastic waste, using data from GREET 2020 (Greenhouse gases, Regulated Emissions, and Energy use in Technologies model). GREET provides the inventory of data for a variety of processes with detailed information of energy use, material consumption and the resulting emissions.

Figure 6:
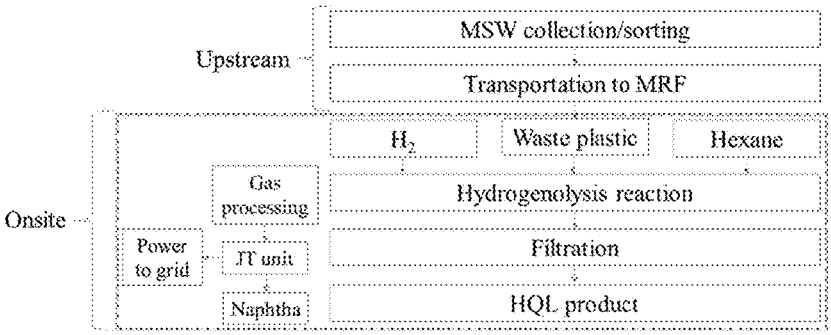
FIG. 6 is a block diagram showing the boundaries for the HQL process of the disclosure.

The system boundary used for the LCA is shown in FIG. 6, which includes the process scheme shown in FIG. 4 plus the materials consumption, energy use, and emissions for collection, separation, and transportation of MSW to an MRF, thereby constituting a cradle-to-gate LCA. The emissions profile reported in this study was generated for production of 1 kg of HQL.

Figure 7A:
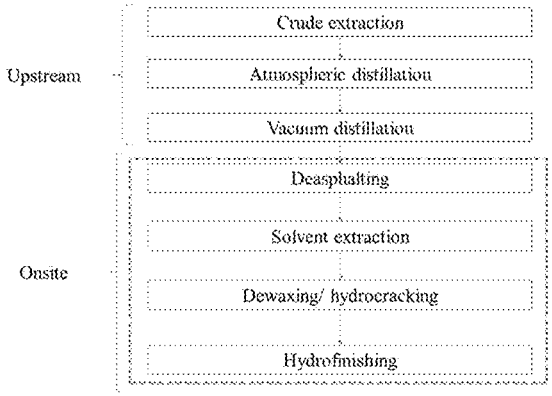
FIGS. 7A and 7B are block diagrams for conventional mineral lubricant and PAO production processes, respectively.
Figure 7B:
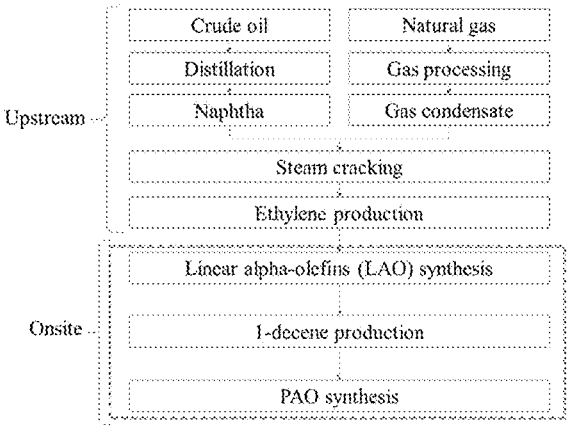

To quantify the potential environmental benefit of converting plastic waste to HQL lubricant, the conventional processes for group III and PAO lubricants were taken as baselines. In FIGS. 7A and 7B, the system boundary for the conventional processes are shown. For both processes, the production of 1 kg of lubricant oil (group III and PAO, respectively) was used as functional unit. The stages in FIG. 7B can also be divided into onsite and upstream. Herein onsite part of the process begins from ethylene as the raw material, which is followed by linear alpha olefins synthesis to produce 1-decene, which serves as the raw material for polyalphaolefin (PAO) lubricant production with PAO as the final product. The upstream part of the process includes the steps up to ethylene production.

To quantify the effects of solid waste upcycling, it was important to assess the reduction in solid waste as a part of this environmental analysis. Therefore, solid waste reduction analysis was carried out in addition to establishing carbon reduction profile using LCA. For this estimation, the net amount of solid waste reduction was calculated accounting for the plastic used as raw material and the average catalyst support material disposed, which was calculated from the total catalyst support used over the lifetime of the plant. The average catalyst support material disposed was also used as a basis for solid waste reduction comparison to an average lubricant production process.

The total material and energy streams are listed in Tables 4-6.

TABLE 4

Summary stream table for the two scenarios. The catalyst consumption rate was calculated based on the full replacement of the catalyst every three years during the total life of the plant (i.e. 40 years).

| | | LY | HY | UNIT |
|---|---|---|---|---|
| INPUT | HDPE | 1.64 | 1.10 | KG $KG_{HQL}^{-1}$ |
| | $H_2$ MAKEUP | 0.0562 | 0.02 | KG $KG_{HQL}^{-1}$ |
| | AIR | 7.80 | 1.92 | KG $KG_{HQL}^{-1}$ |
| | HEXANE MAKEUP | 0.004 | 0.002 | KG $KG_{HQL}^{-1}$ |
| OUTPUT | HQL | 153 | 227 | MT $DAY^{-1}$ |
| | NAPHTHA | 0.304 | 0.034 | KG $KG_{HQL}^{-1}$ |
| | FLUE GAS | 8.19 | 2.01 | KG $KG_{HQL}^{-1}$ |
| $CO_2$ IN FLUE GAS | | 1.08 | 0.24 | KG $KG_{HQL}^{-1}$ |
| COOLING WATER | | 377.96 | 116.97 | KG $KG_{HQL}^{-1}$ |
| PROCESS WATER | | 0.73 | 0.22 | KG $KG_{HQL}^{-1}$ |
| CATALYST CONSUMPTION | | 4.70 | 8.81 | KG |
| RATE | | $10^{-4}$ | $10^{-5}$ | $MT_{HQL}^{-1}$ |

TABLE 5

Summary stream table of the process with lubricant yield of 60%. The components flow rates are listed in mole basis.

| | 1 | 2 | 3 | 4 | 5 | 6 |
|---|---|---|---|---|---|---|
| Temperature/° C. | 25.00 | 25.00 | 25.00 | 41.87 | 43.28 | 29.13 |
| Pressure/bar | 1.01 | 20.00 | 1.01 | 11.72 | 1.01 | 10.95 |
| Phase | Solid | Gas | Solid | Gas | G + L | G + L |
| Mass flowrate/t $day^{-1}$ | 250.00 | 8.59 | 250.00 | 14.21 | 152.88 | 47.12 |
| Mole flowrate/kmol $h^{-1}$ | 0.30 | 177.54 | 0.30 | 293.10 | 14.21 | 31.20 |
| HDPE | 0.30 | 0 | 0.30 | 0 | 0 | 0 |
| $H_2$ | 0 | 177.54 | 0 | 293.02 | 0.16 | 0.01 |
| $CH_4$ | 0 | 0 | 0 | 0.08 | 0.19 | 0.94 |
| $C_2H_6$ | 0 | 0 | 0 | 0 | 0.10 | 3.10 |
| $C_3H_8$ | 0 | 0 | 0 | 0 | 0.07 | 5.43 |
| $C_4H_{10}$ | 0 | 0 | 0 | 0 | 0.11 | 9.85 |
| $C_5H_{12}$ | 0 | 0 | 0 | 0 | 0.07 | 3.96 |
| $C_6H_{14}$ | 0 | 0 | 0 | 0 | 0.43 | 3.80 |
| $C_7H_{16}$ | 0 | 0 | 0 | 0 | 0.20 | 2.76 |
| $C_8H_{18}$ | 0 | 0 | 0 | 0 | 0.14 | 1.34 |
| $C_{35}H_{72}$ | 0 | 0 | 0 | 0 | 12.73 | 0 |
| $O_2$ | 0 | 0 | 0 | 0 | 0 | 0 |
| $N_2$ | 0 | 0 | 0 | 0 | 0 | 0 |
| $CO_2$ | 0 | 0 | 0 | 0 | 0 | 0 |
| $H_2O$ | 0 | 0 | 0 | 0 | 0 | 0 |

| | 7 | 8 | 9 | 10 | 11 |
|---|---|---|---|---|---|
| Temperature/° C. | 43.03 | 25.00 | 3.76 | 25.00 | 130.06 |
| Pressure/bar | 8.00 | 1.01 | 5.00 | 1.01 | 1.30 |
| Phase | Gas | Liquid | Gas | Gas | Gas |
| Mass flowrate/t $day^{-1}$ | 5.62 | 0.59 | 59.18 | 1192.25 | 1251.43 |
| Mole flowrate/kmol $h^{-1}$ | 115.56 | 0.29 | 132.41 | 1721.89 | 1866.47 |
| HDPE | 0 | 0 | 0 | 0 | 0 |
| $H_2$ | 115.48 | 0 | 20.36 | 0 | 0 |
| $CH_4$ | 0.08 | 0 | 79.07 | 0 | 0 |
| $C_2H_6$ | 0 | 0 | 23.53 | 0 | 0 |
| $C_3H_8$ | 0 | 0 | 7.36 | 0 | 0 |
| $C_4H_{10}$ | 0 | 0 | 1.92 | 0 | 0 |
| $C_5H_{12}$ | 0 | 0 | 0.13 | 0 | 0 |
| $C_6H_{14}$ | 0 | 0.29 | 0 | 0 | 0 |
| $C_7H_{16}$ | 0 | 0 | 0 | 0 | 0 |
| $C_8H_{18}$ | 0 | 0 | 0 | 0 | 0 |
| $C_{35}H_{72}$ | 0 | 0 | 0 | 0 | 0 |
| $O_2$ | 0 | 0 | 0 | 361.60 | 60.27 |
| $N_2$ | 0 | 0 | 0 | 1360.29 | 1360.29 |
| $CO_2$ | 0 | 0 | 0 | 0 | 156.75 |
| $H_2O$ | 0 | 0 | 0 | 0 | 289.16 |

TABLE 6

Summary stream table of the process with lubricant yield of 90%. The components flow rates are listed in mole basis.

| | 1 | 2 | 3 | 4 | 5 | 6 |
|---|---|---|---|---|---|---|
| Temperature/° C. | 25.00 | 25.00 | 25.00 | 54.28 | 44.16 | 33.98 |
| Pressure/bar | 1.01 | 20.00 | 1.01 | 11.72 | 1.01 | 10.95 |
| Phase | Solid | Gas | Solid | Gas | G + L | G + L |
| Mass flowrate/t $day^{-1}$ | 250.00 | 4.41 | 250.00 | 14.18 | 226.80 | 7.67 |
| Mole flowrate/kmol $h^{-1}$ | 0.30 | 91.21 | 0.30 | 293.04 | 20.03 | 4.43 |
| HDPE | 0.30 | 0 | 0.30 | 0 | 0 | 0 |
| $H_2$ | 0 | 91.21 | 0 | 293.02 | 0.43 | 0.01 |
| $CH_4$ | 0 | 0 | 0 | 0.02 | 0.07 | 0.10 |
| $C_2H_6$ | 0 | 0 | 0 | 0 | 0.04 | 0.30 |
| $C_3H_8$ | 0 | 0 | 0 | 0 | 0.03 | 0.45 |
| $C_4H_{10}$ | 0 | 0 | 0 | 0 | 0.04 | 1.03 |
| $C_5H_{12}$ | 0 | 0 | 0 | 0 | 0.02 | 0.65 |
| $C_6H_{14}$ | 0 | 0 | 0 | 0 | 0.25 | 0.86 |
| $C_7H_{16}$ | 0 | 0 | 0 | 0 | 0.04 | 0.69 |
| $C_8H_{18}$ | 0 | 0 | 0 | 0 | 0.03 | 0.34 |
| $C_{35}H_{72}$ | 0 | 0 | 0 | 0 | 19.10 | 0 |
| $O_2$ | 0 | 0 | 0 | 0 | 0 | 0 |
| $N_2$ | 0 | 0 | 0 | 0 | 0 | 0 |
| $CO_2$ | 0 | 0 | 0 | 0 | 0 | 0 |
| $H_2O$ | 0 | 0 | 0 | 0 | 0 | 0 |

TABLE 6-continued

Summary stream table of the process with lubricant yield of 90%. The components flow rates are listed in mole basis.

| | 7 | 8 | 9 | 10 | 11 |
|---|---|---|---|---|---|
| Temperature/° C. | 43.03 | 25.00 | 19.36 | 25.00 | 130.00 |
| Pressure/bar | 8.00 | 1.01 | 10.95 | 1.01 | 1.30 |
| Phase | Gas | Liquid | Gas | Gas | Gas |
| Mass flowrate/t $day^{-1}$ | 9.77 | 0.46 | 20.41 | 435.10 | 455.51 |
| Mole flowrate/kmol $h^{-1}$ | 201.83 | 0.22 | 66.97 | 628.39 | 687.37 |
| HDPE | 0 | 0 | 0 | 0 | 0 |
| $H_2$ | 201.81 | 0 | 35.61 | 0 | 0 |
| $CH_4$ | 0.02 | 0 | 19.88 | 0 | 0 |
| $C_2H_6$ | 0 | 0 | 6.35 | 0 | 0 |
| $C_3H_8$ | 0 | 0 | 2.74 | 0 | 0 |
| $C_4H_{10}$ | 0 | 0 | 1.90 | 0 | 0 |
| $C_5H_{12}$ | 0 | 0 | 0.37 | 0 | 0 |
| $C_6H_{14}$ | 0 | 0.22 | 0 | 0 | 0 |
| $C_7H_{16}$ | 0 | 0 | 0 | 0 | 0 |
| $C_8H_{18}$ | 0 | 0 | 0 | 0 | 0 |
| $C_{35}H_{72}$ | 0 | 0 | 0 | 0 | 0 |
| $O_2$ | 0 | 0 | 0 | 131.96 | 21.99 |
| $N_2$ | 0 | 0 | 0 | 496.43 | 496.43 |
| $CO_2$ | 0 | 0 | 0 | 0 | 50.99 |
| $H_2O$ | 0 | 0 | 0 | 0 | 117.96 |

The scenario characterized by a lubricant yield of 60% led to a HQL production of 153 MT $day^{-1}$ and about 46 MT $day^{-1}$ of naphtha. Increasing the lubricant yield from 60% to 90% led to a 50% increase in lubricant production. The case with 90% yield was also characterized by a lower amount of hydrogen consumption per kg of HQL, due to the lower production of light hydrocarbons, the formation of which requires more $H_2$ than liquid products. Moreover, the on-site $CO_2$ emissions decreased by 78% due to the lower amount of fuel gas burnt for power generation. The amount of co-product decreased to about 8 MT $day^{-1}$, as well as the net electric power produced, that decreased by 42%.

The energy balance is summarized in Table 7.

TABLE 7

Energy balance and process efficiency for both low-yield and high-yield cases.

| | | LY | HY | UNIT |
|---|---|---|---|---|
| INPUT | HDPE | 128.3 | 128.3 | MW |
| | $H_2$ | 11.9 | 6.1 | MW |
| | POWER | 5.8 | 4.3 | MW |
| OUTPUT | HQL | 78.3 | 116.2 | MW |
| | NAPHTHA | 24.6 | 4.1 | MW |
| | POWER | 10.6 | 3.1 | MW |
| EFFICIENCY | | 78% | 89% | |

The process energy efficiency was calculated based on the energy of the product, co-product, and feedstock materials:

$$\text{Efficiency} = \frac{E_{HDPE} + E_{H_2} + W_{e,IN}}{E_{HQL} + E_{naphtha} + W_{e,OUT}} \quad \text{(eq. 6)}$$

Here, E is the energy content of feedstock and products based on the low heating value (LHV), while $W_e$ is the electric power needed (IN) and generated (OUT). For the cases with 90% yield, both the increase in HQL productivity and decrease in hydrogen demand led to a more efficient process overall, with an energy efficiency of 89%.

LCA Results

The $CO_2$ emissions associated with the production of plastic-derived lubricant are a vital parameter to ensure the environmental benefit synergy between solid waste reduction and air emission reduction. This section provides results for the emissions profile of HQL process, a discussion on petroleum lubricant emissions as a baseline, and the sensitivity case of conventional synthetic lubricant (PAO) production process.

Solid waste reduction by plastic upcycling. The process for conversion of plastics to HQL product used 91,250 mt $year^{-1}$ of HDPE feedstock. From a solids material balance viewpoint this corresponds to the total input solid HDPE that is converted to HQL. In this process, the only solid waste generated over the lifetime of the plant comes from catalyst support that is disposed, since the metal, Pt, is recovered owing to its high cost and value. Therefore, based on the amount of support catalyst generating the sole source of solid waste, on a yearly average of 6.63 mt $year^{-1}$, this process is likely to bring about a reduction in solid waste by 99.9%.

A conventional process for mineral lube production is estimated to yield an average of 40 mt of solid waste, in the form of clay. Compared to this value, the current process accounts for over 83% reduction in solid waste, for lubricant production. It is important to point here that along with this reduction in solid waste, the lubricant product obtained from the process in this research is of a higher quality than mineral lube.

Emissions from the plastic waste derived lubricant. The total $CO_2$ emissions produced from the combustion of fuel gas are listed in Table 8 for both scenarios. In the LY case study, the combustion of fuel gas generated a surplus of power, which was accounted as power injected into the grid. The HY case produced nearly 80% less $co_2$ from power generation, due to the lower amount of light hydrocarbons produced from the HDPE hydrogenolysis.

TABLE 8

Carbon emissions generated by the HQL process from combustion of light gases.

| LY | HY | UNIT |
|---|---|---|
| 1.08 | 0.24 | $KG_{CO2}$ $KG_{HQL}^{-1}$ |
| 3.25 | 0.72 | $KG_{CO2}$ $GAL_{HQL}^{-1}$ |

The cradle-to-gate $CO_2$ emissions of the lubricant production from plastic waste was calculated by accounting for the upstream burdens of feedstocks and other material and energy inputs. In FIG. 10, the total carbon emissions for each scenario are reported. Upstream emissions of hexane and the catalyst were omitted from the chart as they accounted for less than 0.2% of the total emissions. The HQL product was characterized by well-to-gate (WTG) emissions equal to 1.17 $kg_{CO2e}$ $kg_{HQL}^{-1}$ (3.52 $kg_{CO2e}$ $gal_{HQL}^{-1}$) and 0.48 $kg_{CO2e}$ $kg_{HQL}^{-1}$ (1.41 $kg_{CO2e}$ $gal_{HQL}^{-1}$) for the LY and HY cases, respectively.

Petroleum lubricant well-to-gate $co_t$ emission as a baseline. FIG. 7A provides a general scheme for the industrial production of lubricant base oils from crude oil. The production process can be divided into an onsite and an upstream fraction. Mineral base oil is synthesized from vacuum gas oil (VGO) or waxy distillates (both obtained from vacuum distillation of crude oil) as starting raw materials. As such, the processing steps up to vacuum distillation are usually considered upstream of the actual onsite lubricant synthesis process. It is therefore important to point that the emissions associated with the onsite production of lubricants takes into consideration the burden arising due to the use of heat, electricity and fuel needed for the various onsite processes, as shown in FIG. 7A Despite the existence of some energy consumption data for lubricant product, the $CO_2$ emission has been rarely reported, as most studies focused on the refinery emissions allocated to major products, such as gasoline, diesel, jet, naphtha, pet coke, etc. The $CO_2$ emission is highly depended on refinery crude slates, refinery product slates, and refinery's operating conditions. We conducted a unit-based process analysis to obtain a detailed breakdown of energy sources, in order to obtain $CO_2$ emissions by using emission factors of various energy sources. In addition, we developed a detailed input inventory list, to calculate the upstream burden for lubricant production.

The results presented here consolidate a baseline for the lubricant production process calculated from available literature. Table 6 shows sources from the literature which provided a comparison of emissions data for the current technology to literature available for emissions associated with lubricant production. According to the energy and environmental profile for US refineries, the total fuel and electricity consumption for lubricant production is reported to be 11.26 MJ $kg_{Lub}^{-1}$ and 0.5 MJ $kg_{Lub}^{-1}$, respectively. Other sources reported fuel and electricity use at 11.56 MJ/$kg_{Lu}$b and 0.06 MJ $kg_{Lub}^{-1}$, respectively, for a paper that reports criteria air pollutant and greenhouse gas emissions allocated to refinery products for US refineries. Best Available Techniques (BAT) for refining of mineral oil and gas, a European Commission report, also provides fuel and electricity use at 6.07 MJ $kg_{Lub}^{-1}$ and 0.21 MJ $kg_{Lub}^{-1}$, respectively. The corresponding onsite $CO_2$ for lubricant production fall in the range of 0.89-1.35 $kg_{CO2}$ $kg_{Lub}^{-1}$.

Synthetic lubricant (PAO) emissions profile. The total onsite energy input of the process includes power, heat, and steam. The energy consumption is 2.37 MJ $kg_{Lub}^{-1}$ and 9.60 MJ $kg_{Lub}^{-1}$, for power and thermal components, respectively. This energy consumption together corresponds to a total $CO_2$ emission of 0.81 $kg_{CO2}$ $kg_{Lub}^{-1}$, wherein emissions from U.S. grid mix electricity and natural gas-based boiler. Upstream emissions for ethylene production were obtained from GREET and it amounted to 0.84 $kg_{CO2}$ $kg_{Lub}^{-1}$,[9] bringing the total emissions for PAO lubricant to 1.65 $kg_{CO2}$ $kg_{Lub}^{-1}$.

Figure 8:
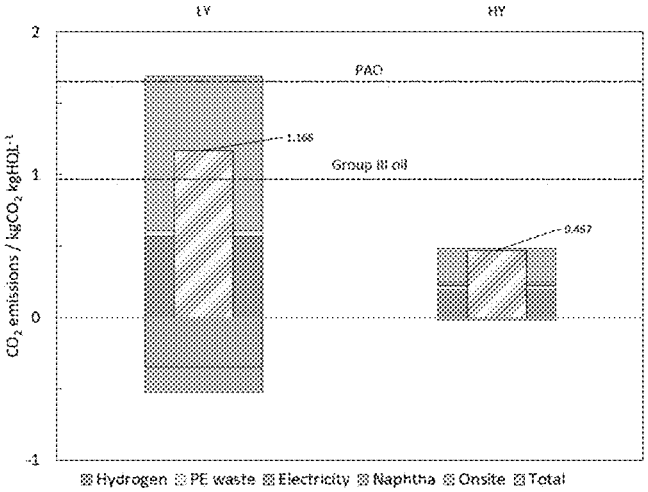
FIG. 8 is a schematic illustration showing the breakdown of total carbon emissions of the process of the disclosure.

As seen in FIG. 8, the process for HQL production has $CO_2$ emissions in the range of 0.48-1.2 $kg_{CO2e}$ $kg_{HQL}^{-1}$, for a cradle-to-gate basis, considering all onsite and upstream emissions. Therefore, on a cradle-to-gate framework, mineral lube production would lead to nearly twice the amount of $CO_2$ per kg of lubricant produced, and PAO production would emit about 3.5 times more $CO_2$.

Plastics upcycling is a field with high potential for waste-to-value generation and has as such garnered active interest from researchers. A variety of high-value products such as fuels, construction materials, nanomaterials, hydrogen, and lubricants have been obtained using pre-consumer and waste plastics alike, thereby developing novel waste-to-value routes.[21,58,59] In terms of emissions, with the validated 90% yield, the HQL synthesis from HDPE led to 0.48 $kg_{CO2}$ $kg_{HQL}^{-1}$. This represented a 52% reduction in the WTG $CO_2$ emission relative to group III lubricant oil and a 72% reduction respect to PAO, as well as 99.9% of solid waste reduction Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In the case of conflict, the present description, including definitions, will control.

Throughout the specification, where the compounds, compositions, methods, and/or processes are described as including components, steps, or materials, it is contemplated that the compounds, compositions, methods, and/or processes can also comprise, consist essentially of, or consist of any combination of the recited components or materials, unless described otherwise. Component concentrations can be expressed in terms of weight concentrations, unless specifically indicated otherwise. Combinations of components are contemplated to include homogeneous and/or heterogeneous mixtures, as would be understood by a person of ordinary skill in the art in view of the foregoing disclosure.

What is claimed:

1. A process for conversion of a plastic feedstock to a liquid lubricant product, comprising:

admixing the plastic feedstock with a hydrocarbon solvent;

heating the plastic feedstock and hydrocarbon solvent in the presence of a hydrogenolysis/hydrocracking catalyst in a conversion reactor with a flow of $H_2$ to a conversion temperature to form a slurry;

holding the slurry at the conversion temperature for a retention time sufficient to convert substantially all of the plastic feedstock to a liquid lubricant;

removing the liquid lubricant and hydrocarbon solvent from the conversion reactor and flowing the liquid lubricant and hydrocarbon solvent into a distillation column, wherein the liquid lubricant and hydrocarbon solvent is separated from the hydrogenolysis/hydrocracking catalyst before the liquid lubricant and hydrocarbon solvent is flowed into the distillation column;

recovering the hydrogenolysis/hydrocracking catalyst separated from the liquid lubricant and transferring the recovered catalyst to a catalyst filter unit after the liquid lubricant is removed from the conversion reactor;

washing the recovered catalysts in the catalyst filter using a washing solvent introduced into the catalyst filter, wherein any lubricant remaining on the recovered catalysts will be dissolved into the washing solvent during washing;

returning the washed catalyst to the conversion reactor for reuse;

flowing the washing solvent after catalyst washing to the distillation column;

purifying the liquid lubricant, hydrocarbon solvent and washing solvent in the distillation column to recover hydrocarbon solvent and washing solvent;

recovering the purified hydrocarbon solvent and washing solvent for reuse; and collecting the liquid lubricant product.

2. The process of claim 1, wherein the washing solvent after catalyst washing is flowed into the distillation column at a level above which the liquid lubricant is flowed into the distillation column.

3. The process of claim 1, wherein the purified solvent is recovered and removed from the distillation column at a head of the distillation column and the liquid lubricant product is collected from a bottom of the distillation column.

4. The process of claim 1, wherein the hydrogenolysis/hydrocracking catalyst comprises one or more platinum group metals and/or transition metals.

5. The process of claim 4, wherein the platinum group metal and/or transition metal is one or more of Pt, Ni, Co, and Pd.

6. The process of claim 4, wherein the platinum group metal and/or transition metal is deposited on a support.

7. The process of claim 6, wherein the support is a metal oxide or active carbon.

8. The process of claim 6, wherein the support is one or more of $SrTiO_3$, $TiO_2$, MgO, $WO_3$, $ZrO_2$, amorphous aluminosilicate, (modified) zeolite, active carbon, mesoporous support, etc..

9. The process of claim 4, wherein the catalyst comprises about 0.1 wt % to about 20 wt % Pt based on the total weight of the catalyst.

10. The process of claim 1, wherein unreacted $H_2$ and/or $C_1$-$C_8$ hydrocarbon gases formed during conversions of the plastic feedstock in the conversion reactor are vented from the conversion reactor and diverted to a boiler for combustion.

11. The process of claim 1, wherein $C_4$-$C_8$ hydrocarbon gases formed during the conversion of the plastic feedstock in the conversion reactor are processed through a Joule-Thomson unit for recovery of naphtha.

12. The process of claim 1, wherein the plastic feedstock comprises one or more of HDPE, LDPE, and LLDPE.

13. The process of claim 1, wherein the hydrocarbon solvent is one or more of butane, pentene, hexane, and naphtha.

14. The process of claim 1, wherein the hydrocarbon solvent and plastic feedstock are co-fed into the conversion reactor.

15. The process of claim 1, wherein the separated hydrocarbon solvent is recovered from the distillation column and flowed back into the conversion reactor.

16. The process of claim 1, wherein the conversion reactor comprises a filter arranged such that the liquid lubricant passes through the filter and can be removed from the conversion reactor while the hydrogenolysis/hydrocracking catalyst remains on the filter and within the conversion reactor thereby separating the liquid lubricant from the hydrogenolysis/hydrocracking catalyst.

17. The process of claim 1 wherein the slurry is removed from the conversion reactor and flowed to a slurry filtration unit for separating the hydrogenolysis/hydrocracking catalysts from the liquid lubricant before the liquid lubricant is flowed into the distillation column, or wherein the slurry is removed from the conversion reactor and flowed to the catalyst filter unit for separating the hydrogenolysis/hydrocracking catalyst from the liquid lubricant, the liquid lubricant is then flowed from the catalyst filter unit to the distillation column, while the catalyst remains in the catalyst filter unit for washing.

18. The process of claim 1, wherein the washing solvent is one or more of hexane, pentane, or a paraffin.

19. A process for conversion of a plastic feedstock to a liquid lubricant product, comprising:

heating the plastic feedstock in the presence of a hydrogenolysis/hydrocracking catalyst in a conversion reactor with a flow of H2 to a conversion temperature to form a slurry;

holding the slurry at the conversion temperature for a retention time sufficient to convert substantially all of the plastic feedstock to a liquid lubricant;

removing the liquid lubricant from the conversion reactor and flowing the liquid lubricant into a distillation column, wherein the liquid lubricant is separated from the hydrogenolysis/hydrocracking catalyst before the liquid lubricant is flowed into the distillation column;

recovering the hydrogenolysis/hydrocracking catalyst separated from the liquid lubricant and transferring the recovered catalyst to a catalyst filter unit after the liquid lubricant is removed from the conversion reactor;

washing the recovered catalysts in the catalyst filter using a washing solvent introduced into the catalyst filter, wherein any lubricant remaining on the recovered catalysts will be dissolved into the washing solvent during washing;

returning the washed catalyst to the conversion reactor for reuse;

flowing the washing solvent after catalyst washing to the distillation column;

purifying the liquid lubricant and washing solvent in the distillation column to recover solvent;

recovering the purified washing solvent for reuse; and collecting the liquid lubricant product;

wherein a liquid lubricant yield of the process is in a range of 60% to 90%.

20. The process of claim 19, wherein the hydrogenolysis/hydrocracking catalyst comprises platinum deposited on a support selected from $SrTiO_3$, $TiO_2$, MgO, $WO_3$, $ZrO_2$, active carbon and mesoporous support.

* * * * *